US007597049B2

(12) United States Patent
Leonowicz

(10) Patent No.: US 7,597,049 B2
(45) Date of Patent: Oct. 6, 2009

(54) MODEL RAILROAD TRACK SCRUBBING CAR

(76) Inventor: Robert Scott Leonowicz, 2763 Eaton Rd., Green Bay, WI (US) 54311-6507

( * ) Notice: Subject to any disclaimer, the term of this patent is extended or adjusted under 35 U.S.C. 154(b) by 40 days.

(21) Appl. No.: 12/004,936

(22) Filed: Dec. 21, 2007

(65) Prior Publication Data

US 2008/0216702 A1 Sep. 11, 2008

(51) Int. Cl.
*A63H 19/15* (2006.01)

(52) U.S. Cl. ..... 105/1.5; 105/238.2; 104/DIG. 1

(58) Field of Classification Search ..... 105/1.5, 105/238.2; 104/DIG. 1, 279
See application file for complete search history.

(56) References Cited

OTHER PUBLICATIONS

Maintence on Wheel's website print out of www.trackman2000.com with 1999-2003 copyright notice.

Maintence on Wheel's image of Trackman 2000 model railroad track cleaning car from www.tackman2000.com website.

CMX Products, Jct., Vermont brochure of CMX Clean Machine dated Sep. 2006 printed from www.dccsupplies.com.

CMX Products, Jct., Vermont image of CMX Clean Machine model railroad track cleaning car from www.dccsupplies.com website.

Aztec Manufacturing Co.'s website print out of www.aztectrains.com showing the Marauder with 2001-2008 copyright notice.

Aztec Manufacturing Co.'s image of Aztec Marauder model railroad track cleaning car from www.aztectrains.com.

Lionel brochure of 3927 Track Cleaning Car showing printout from www.postwarlionel.com made since 1956-1960.

Lionel image of 3927 Track Cleaning Car model railroad track cleaning car from www.postwarlionel.com.

Railway Pictures website print out of www.railwaypictures.co.uk with 2005 copyright notice.

Railway Pictures image of Tri-Ang R344 model railroad track cleaning car from www.railwaypictures.co.uk.

*Primary Examiner*—S. Joseph Morano
*Assistant Examiner*—Zachary Kuhfuss
(74) *Attorney, Agent, or Firm*—Jeffrey S. Sokol; Cook & Franke, S.C.

(57) ABSTRACT

The invention is a model railroad track scrubbing car with rollers set at a scrub angle of about 30° to scrubs the tops and sides of the track rails. The rollers freely rotate about fixed axle under the chassis of the weighted car. Each roller is preferably a conventional paint roller with an inner sleeve and an outer tubular roll made of an absorbent, compressible, resilient foam material. The active working surfaces of each roller compress against, frictionally engage and deform around the tops and sides of the rails. The scrub angle and rollers provide across-the-rail scrubbing action and possibly along-the-rail scrubbing action. The circumferential working areas of the rollers are wider than the width of their associated track rails. The scrub angle and height of the roller axle above the track rails are adjustable to set the amount of roller compression and scrubbing action against the track rails.

13 Claims, 5 Drawing Sheets

MODEL RAILROAD TRACK SCRUBBING CAR

TECHNICAL FIELD OF THE INVENTION

This invention relates to a model railroad track scrubbing car with resiliently compressible, absorbent rollers that engage and scrub the top and sides of the track rails, where each roller is rotatably secured to a fixed axle set to a scrub angle to provide rotating circumferential working engagement with the rails and across-the-rail scrubbing action.

BACKGROUND OF THE INVENTION

Model railroading is a growing industry, and has become more high-tech in recent years. The locomotives and engines include solid state electric circuits that include contact roller pickups on their underside that rest on the track rails. The track rails are made of steel, brass, or nickel-silver, and are energized with a variable voltage and electric current supplied by a power source and transformer. One rail is energized to a first, positive or higher voltage. Another rail is energized to a second, grounded, negative or lower voltage. Nonconductive or insulated cross ties join the rails and maintain them a desired uniform distance apart. The metal wheels and contact rollers of the engines must pick up the voltage differential between the rails to receive a corresponding electric current from the track. Many accessory cars have lights and acoustic speakers that are also powered by the voltage differential and electric current received from the track rails. Good electrical contact or communication between the contacts and wheels of the engine and accessory cars with the track rails is required. The cleaner the track rails, the better and smoother the operation of the engines, cars and train.

A problem with model railroad layouts is that the track becomes dirty from day-to-day operation on a typical track layout. Dirt, grease, grime and other debris can coat the surfaces of the track rails and disrupt or inhibit good electrical communication between the track rails and the contacts and wheels of the locomotives, engines, and accessory cars. All purpose cleaners, such as Goo Gone™ cleaning and degreasing preparation, applied by hand with a cloth rag work well to clean the track rails. However, due to the size and complexity of some layouts, it is difficult to hand clean the entire layout. For example, it is nearly impossible to hand clean the track extending through a tunnel or in remote or otherwise hard-to-reach areas. A few conventional track-cleaning car designs have been developed to travel around the layout and clean the track rails.

A problem with conventional model railroad track cleaning cars is that they do not clean the track rails as well as they allege. These cars tend to clean only the outline or footprint of the mid section of the car, and miss the outermost rail on curved sections of track. The Lionel #3927 track cleaning car features a single, flat, disc shaped pad that spins across the tops of the three O-gage rails. A motor spins the horizontal pad about a vertical axis perpendicular to the rails. The center or spin axis of pad is generally located over the center rail of the track when the 3927 unit is traveling along straight track. While the entire surface area of the spinning pad engages the center rail, only a relatively small outer or perimeter area engages the two outer rails. The front-to-rear wheel base of the unit is relatively short so that at least some small portion of the single spinning pad continues to engage the outermost rail when traveling along curved track. The outer perimeter of the pad quickly becomes dirty, worn and less effective for cleaning, particularly relative to the large middle area of the pad. As the outer track rails must be cleaned to obtain good electrical communication with the wheels, the spinning pad requires frequent cleaning and replacement. Yet, OEM replacement cleaning pads for the 3927 unit are expensive, and are not available in hobby or hardware stores. The unit also includes a pad that follows behind, and a container of cleaning fluid. The self-propelled 3927 unit is expensive, and the fluid tends to leak onto the track.

The CMX Clean Machine track cleaning car has a tank car design with lower horizontal cleaning pads. The tank of the car holds cleaning fluid that is dispensed to its cleaning pads. The flat pads are stationarily fixed to the main body of the tank car, and only clean the tops of the rails. The track rails form wear lines into the stationary pads so that they wear out quickly and need to be replaced frequently. Replacement pads can only be purchased through the OEM and are not available in hobby or hardware stores. The CMX model is also expensive, and tends to leak too much fluid onto the pads.

The Trackman 0-2000 track cleaning car is similar to the CMX car in several respects. The Trackman 0-2000 has stationary pads that only clean the tops of the rails. The car includes an alignment mechanism that positions the pads over the track rails when traveling along curved track. The car is expensive, and replacement pads are only available through the OEM. The Tri-Ang-R344 track cleaning car has a fuzzy pad that it drags across the rails, and likewise only cleans the top of the track. This car is manufactured in Great Britain, and obtaining replacement pads is difficult.

The Aztec Marauder track cleaning car includes one hard abrasive cratex roller that it asserts grinds or scrubs corrosion from the top of the rails, and one hard abrasive canvas-covered roller that it asserts mops up debris. The outer surface of each roller is not generally compressible so that they have a set outside diameter of about ¾ inch. The rollers are so hard that they do not engage the sides of the rails, but are limited to engaging the flat top or apex of the rails. The floating rollers are not mounted on an axle. Each floating roller is held by a hard plastic and metal carriage. The lightweight rollers are not pushed down into engagement with the rails other than by their own weight. The carriage holds the rollers substantially perpendicular to the longitudinal axis of the car and rails but at a slight two degree angle. The car is easily pulled along the track with the same amount of force as regular car (e.g., box car, hopper car, freight car) having no track cleaning mechanism. The car does not clean track very well. The thin canvas shell has very limited absorption capability, and there is virtually no friction between the rollers and the rails. The rollers do not engage and clean the outermost rail on sharply curved sections or pieces of track such as O-27, O-31 and O-36 inch curved track. A magnet bar is located behind each roller to remove abrasive shavings and metal objects from the track. Replacement rollers are expensive.

A problem with track cleaning cars is that they can damage accessory track. Most layouts include a variety of conventional accessory track such as switches, crossovers, road crossings and decouplers. These accessory track include raised portions or structures close to or adjacent the rails. While the rails are metal, many of these structures are made of plastic and are more easily abraded or ground down. Electromagnetic decouplers include a widened middle rail with structure for securing the electrically activated magnet. Track cleaning cars that grind or sand the tops of the rails can inadvertently grind or sand these raised portions or structures, which can damage the accessory track by giving them a disfigured appearance or degrading their performance.

Another problem with track cleaning cars is that they can cause a derailment or decoupling as they travel along the layout. By their very nature, track cleaning cars must come in contact with the track rails. Yet, cars with rigid surfaces that engage or come close to the rails can inadvertently strike raised portions or structures of accessory track adjacent the rails. This contact can jerk and derail the train. Track cleaning cars that grind or sand the tops of the rails are also problematic. When the train is traveling along a curved section of track, the grinders disengage from the outermost rail and tend to drop down below the top of that rail. Then, when the train returns to a straight section of track, the grinder or sander pushes against the side of the outermost rail until it jerks or jumps back onto the top of the rail. This jerking or jumping is a distraction and can cause one or more cars to derail or decouple.

The present invention is intended to solve these and other problems.

BRIEF DESCRIPTION OF THE INVENTION

The present invention relates to a model railroad track scrubbing car including a pair of absorbent, compressible and resilient rollers mounted to a pair of fixed horizontal axles under the chassis of the car. Each roller has an inner sleeve so that it freely rotates about its axle. The active working surfaces of each roller compress against, frictionally engage and wrap around the tops and side of the track rails. Each roller is set to a scrub angle of about 30° so that it rotates at a reduced rate relative to the speed of the train to provide rotating circumferential working engagement with the rails and across-the-rail scrubbing action and possibly some along-the-rail scrubbing action. The rollers simultaneously rotate and scrub the tops and sides of the rails. The scrub angle increases the width of the working areas for individual track rails. The scrub angle and height of the roller axles relative to the track are adjustable to set the amount of roller compression and scrubbing action against the track rails, and allow for different length or diameter rollers.

An advantage of the present track scrubbing car is the effectiveness of its scrubbing action. Each roller has a compressible resilient layer that rubs against and wraps around the top and side surfaces of the track rails. The compressed wrapped shape of the rollers increases the active working engagement area between the roll and the rail, and thus the friction and scrubbing or rubbing action of the roller. Each roller is also angled relative to the track rails and normal axis of the car. This scrub angle produces an effective amount of scrubbing action to clean the track rails. Rollers that are free to rotate and are generally perpendicular to the track rails, produce little or no scrubbing action. The forces between the track and roller simply rotate the roller so that the speed of the outer surface of the roller is generally the same as the speed of the train along the track. The scrub angle produces across-the-rail scrubbing action due to the lateral movement of the outer surface of the roller relative to the rails. The scrub angle also slows the rotation of the roller, which may generate along-the-rail scrubbing action. Although the along-the-rail scrubbing action may help clean the rails, the across-the-rail scrubbing action is believed to be particularly effectively in scrubbing both the sides and tops of the rails. A scrub angle of about 10° to 50° and preferably 30° simultaneously produces a good amount of scrubbing action and roller rotation to effectively clean the track rails.

Another advantage of the track scrubbing car is the adjustability of its scrubbing action. The roller axles are lowered or raised relative to the track rails by a height adjustment mechanism to increase or decrease the amount of scrubbing action. The rollers can be set for more vigorous scrubbing action when necessary by lowering them, or less vigorous scrubbing action to extend the life of the rollers by raising them. The amount of scrubbing or rubbing action can also be adjusted depending on the amount of dirtiness or type of dirt or grime on the rails. Too little compression or scrubbing force can cause uneven cleaning. Too much compression or scrubbing force can cause the car to split a switch and derail. One of the two rollers can be removed to decrease the amount of scrubbing action and force need to pull the track cleaning car. When one of the roller is removed, the scrub angle of the remaining roller can be increased beyond 30° if desired. This adjustability allows a person to custom set the amount of scrubbing action appropriate for their particular model railroad layout and specialty track components.

A further advantage of the track scrubbing car is that its rollers rotate during use. As the car travels along the track, the rollers rotate so that the same spot on the outer surface of the roller in not continuously engaging the track rails. This rotation creates an individual circumferential working area on each roller for each track rail. Although increasing the scrub angle decreases the amount of roller rotation, a scrub angle of about 10° to 50° and preferably 30° produces a good amount of roller rotation to effectively rotate the rollers. This rotation increases the duration between necessary roller maintenance or cleaning, and increases the useful life of the rollers.

A still further advantage of the track scrubbing car is the large working areas of the rollers. Although track rails have a relatively narrow width, the scrub angle increases the width of the circumferential working areas of the roller that engages the rails. The compression of the active working area so that it wraps around the tops and sides of the rails also increases the width of the circumferential working area of the roller. The increased width of these working areas helps avoid the formation of grooves, increases the duration of time between necessary roller maintenance or cleaning, and increases the useful life of the rollers.

A still further advantage of the track scrubbing car is its ability to clean straight track. A first roller is mounted to the right side of the car and extends to the left so that it engages both outer rails. A second roller is mounted to the left side of the car and extends to the right so that it also engages both outer rails. The downward or vertical portion of each roller mount is sufficiently close to the sidewall of the car that the roller will engage the outer rail on that side of the car. Although the vertical portion of the mount is generally directly over the outer track rail on that side of the car, the scrub angle allows the mounted end of the roller to engage that rail. The length of the roller and its scrub angle are selected so that the free end of the roller engages the outer rail opposite the roller mount. This arrangement ensures that both rollers scrub and clean both outer rails and any central rail when the car is traveling along a straight section of track.

A still further advantage of the track scrubbing car is its ability to clean curved track. The free end of each roller extends beyond its respective sidewall of the car. When traveling along a curved section of track, both rollers remain engaged with and scrub and clean the innermost rail and any central rail. In addition, at least one roller remains engaged with the outermost rail to scrub and clean that rail. The location, length and scrub angle of the rollers enable at least one roller to clean the outermost rail. The roller mounted to the right side of the car will continue to engage and clean the outermost rail on a curved section that turns to the right. Similarly, the roller mounted to the left side of the car will continue to engage and clean the outermost rail on a curved section that turns to the left. To keep the car a short as possible, one roller is angled forward and the other is angled rearward.

This arrangement allows the front and rear wheel assemblies of the car to be spaced relatively close together without having the wheels contacting the rollers on a curved section of track. The car is able to effectively clean the track along the tightest of curves. The car will clean each rail, even on an 0-27 inch curve track, the sharpest curve track available for 0-Gauge model trains.

A still further advantage of the track scrubbing car is its ability to clean both the top and the sides of the track rails. The compressible roller deforms around the top of each track rail. During operation, the scrub angle causes the working area to scrubbingly engage at least one side of each rail. By setting the rollers in opposite scrub angle directions relative to the normal axis of the car, one roller being angled forward and one roller being angled rearward, the rollers combine to scrub both sides of each rail. This enables the wheels and contacts of the locomotive and accessory cars to achieve better electrically conducting engagement with the rails. The car is able to pick up substantially all the residual dirt and grime on the top and sides of the track rails. After one cleaning pass around the track, a conventional model train will have better electrical contact with the rails and will run noticeably smoother.

A still further advantage of the track scrubbing car is its soft rollers do not damage accessory track. The compressible resilient rollers can engage the raised portions or structures of conventional accessory track that are close to or adjacent the rails without damaging them. The rollers do not grind or sand these raised plastic portions or structures. The rollers also do not grind or sand any electromagnetic decouplers in the layout. As a result, the present track scrubbing car can thoroughly clean the rails without inadvertently damaging accessory track so that they retain their intended appearance and reliably performance their intended function.

A still further advantage of the track scrubbing car is its smooth operation as it travels along a layout. The resilient rollers easily conform to and accommodate the raised portions or structures and shape of the accessory track so that they smoothly pass over them. The soft rollers help avoid or eliminate the types of sudden forces that can derail or decouple the cars of the train as it travels along the layout. The rollers also smoothly transition from curved to straight track and visa versa. When the car returns from a curved section of track to a straight section of track, the roller that has disengaged from the outermost rail smoothly returns to engaging that rail. The smooth operation of the rollers gives the train a more authentic model railroad appearance and helps avoid derailments and decouplings.

A still further advantage of the present track scrubbing car is its economical design. The scrub angle and roller height adjustment mechanism effectively control the amount of scrubbing action. No brakes or extra parts are need to generate scrubbing action. Similarly, there is no need to check for jamming of these roller that can arise from the use of brakes or extra parts. The rollers are easily installed and remove by snapping them onto and off of their mounting axles. The rollers are easily cleaned by rinsing them with a warm water and soap solution, and placed back on the car. The rollers are also conventional paint rollers. Replacement rollers are relatively inexpensive, and can be readily obtained at local hardware and hobby stores.

Other aspects and advantages of the invention will become apparent upon making reference to the specification, claims and drawings.

DESCRIPTION OF THE PREFERRED EMBODIMENTS

Figure 1:
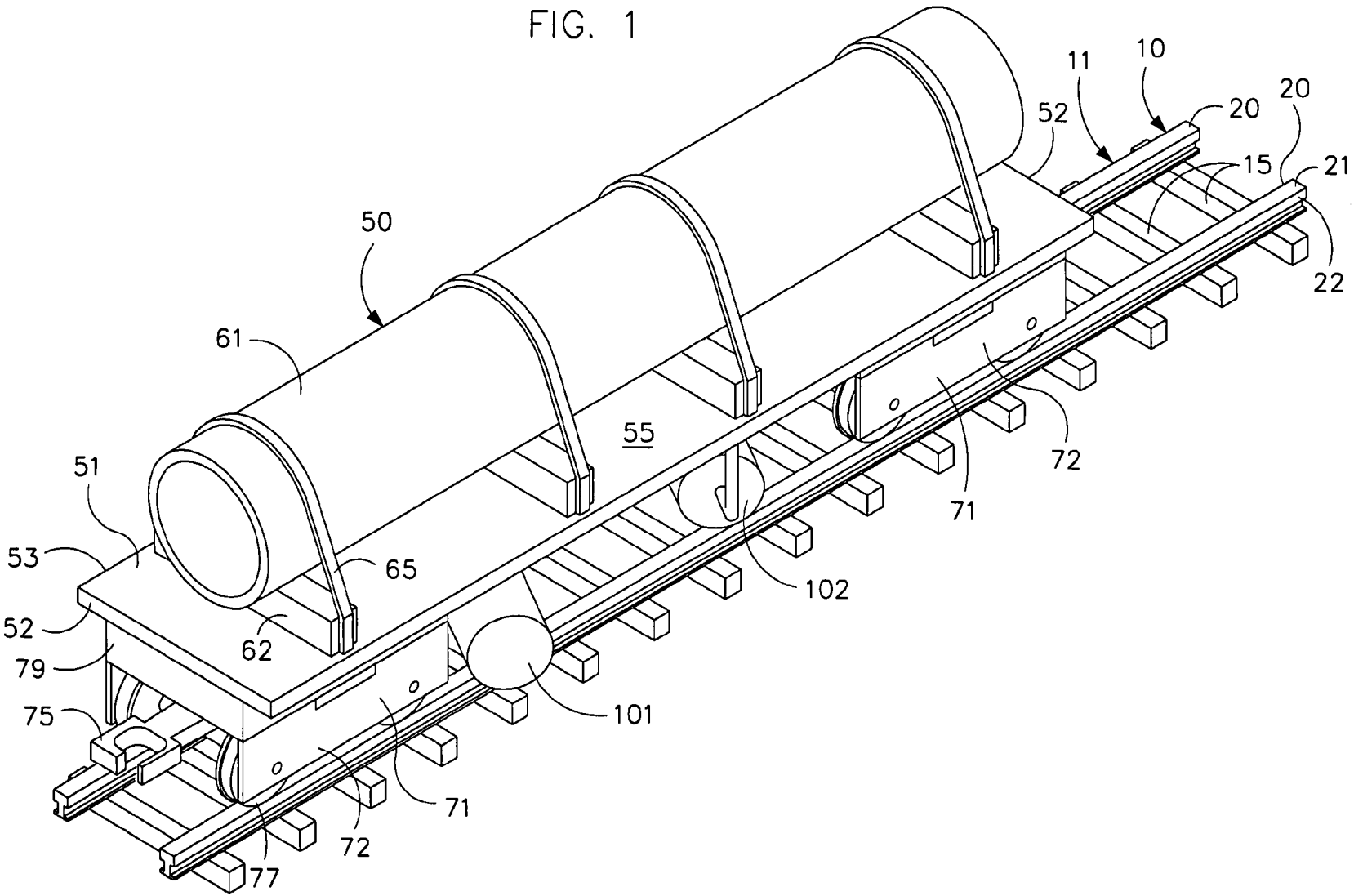
FIG. 1 is a perspective view showing the present track scrubbing car invention with its wheels supportably engaging the rails of a piece of straight track, and with its two track scrubbing rollers compressible engaging the rails.

While this invention is susceptible of embodiment in many different forms, the drawings show and the specification describes in detail a preferred embodiment of the invention. It should be understood that the drawings and specification are to be considered an exemplification of the principles of the invention. They are not intended to limit the broad aspects of the invention to the embodiment illustrated.

The present track scrubbing car is intended to clean the track of an assembled electric model railroad layout. The layout is formed by joining a number of pieces of track 10 together, and includes a transformer connected to an electric power supply such as via an electric cord connected to the wall outlet of a home or building. The transformer typically includes a power control to control the speed of the locomotive engine of a train traveling along the layout. The transformer also includes positive and negative or ground leads that are electrically connected to the track 10. The railroad layout includes straight track 11 and curved track 12. Pieces of track 10 include a number of generally equal length and uniformly spaced cross ties 15. The cross ties 15 form a level platform to support the elongated rails 20 of the track 10. The ends of the cross ties 15 form the side margins or perimeter 17 of the track 10. Some more recent conventional track designs, such as Lionel FasTrack track, have an integrally molded plastic base that extends beyond the ends of its cross ties and forms the side margins of the track 10. Each rail 20 has a narrow cross-sectional width, and is spaced a uniform distance from the perimeter 17 of the track.

Each elongated rail 20 has a top 21 and opposed side 22 surfaces. The top 21 of the track can be flat or arcuate. The longitudinal edges formed by the top 21 and sides 22 are typically rounded. Each rail 20 has a uniform height so that when the pieces of track 10 are joined together they form a continuous level top rail surface 21 and sides for smoothly supporting and engaging the wheels of a train. The continuous top surface 21 and sides 22 of the track 20 also provide a constant electrical connection with the wheels and electrical contacts of the locomotive or accessory cars of the train. This constant electrical connection provides for the smooth operation of the train as it travels along the layout.

Each piece or section of track 10 has two outer rails 25 that support and guide the train around the track layout. All types of track 10 include right and left outer rails 25 that are spaced a uniform distance apart to keep the wheels engaged with the track 10. Some types of track 10 such as O-gauge track also include a third central rail 28 for supplying power to the train locomotive and accessory cars. For 3-rail track systems, the center rail 28 is generally positively charged and both outer rails 25 are grounded. Electricity flows from the positive central rail 28, through a contact extending down from the locomotive or lighted or acoustic accessory car that presses against the central rail, through the electric locomotive or accessory car, and to the grounded outer rails 25 via the wheels engaging those rails. For 2-rail track systems such as in an HO layout, one outside rail 25 is generally positively charged and the other is grounded. Electricity flows from the positive rail, through the wheels engaging that rail, through the locomotive or accessory cars, and to the grounded rail via the wheels engaging that rail. Any grease, dirt and grime that collects on the tops and sides of the rails can inhibit the flow of electricity from the rails 20 to the wheels and contacts, and inhibit the smooth operation of the locomotive and accessory cars of the train.

Figure 2A:
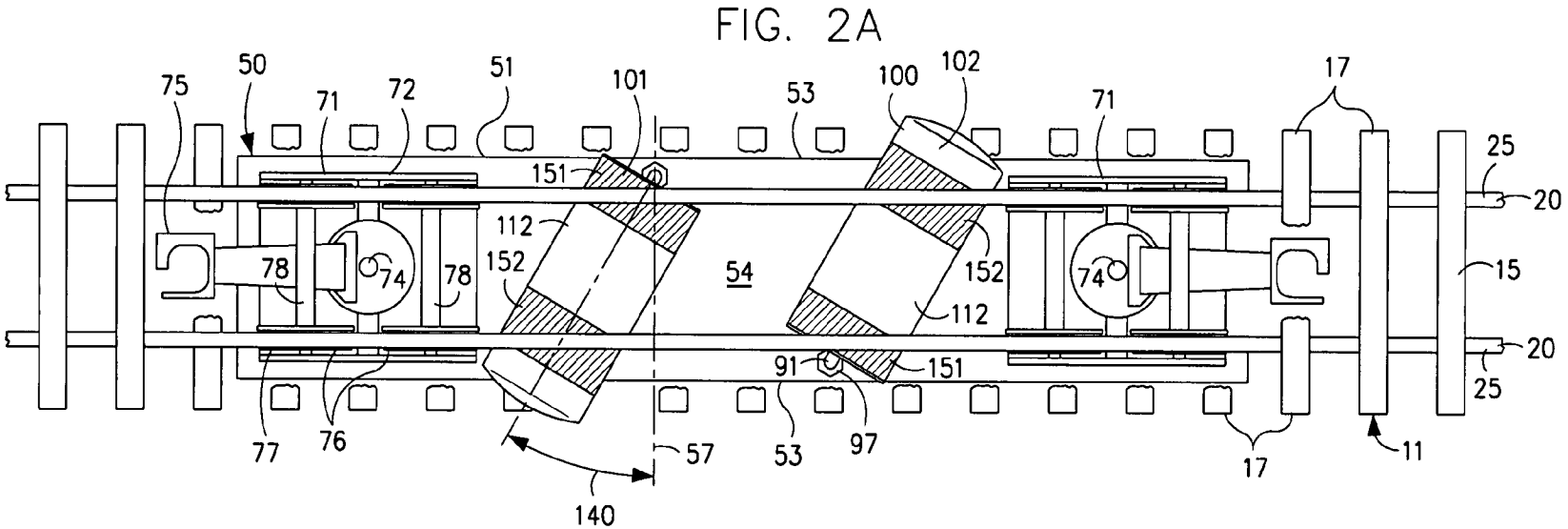
FIG. 2A is a bottom view of the track scrubbing car on 2-rail straight track with each of its rollers at a 30° scrub angle so that movement of the car forms two circumferential working areas on each roller.
Figure 2B:
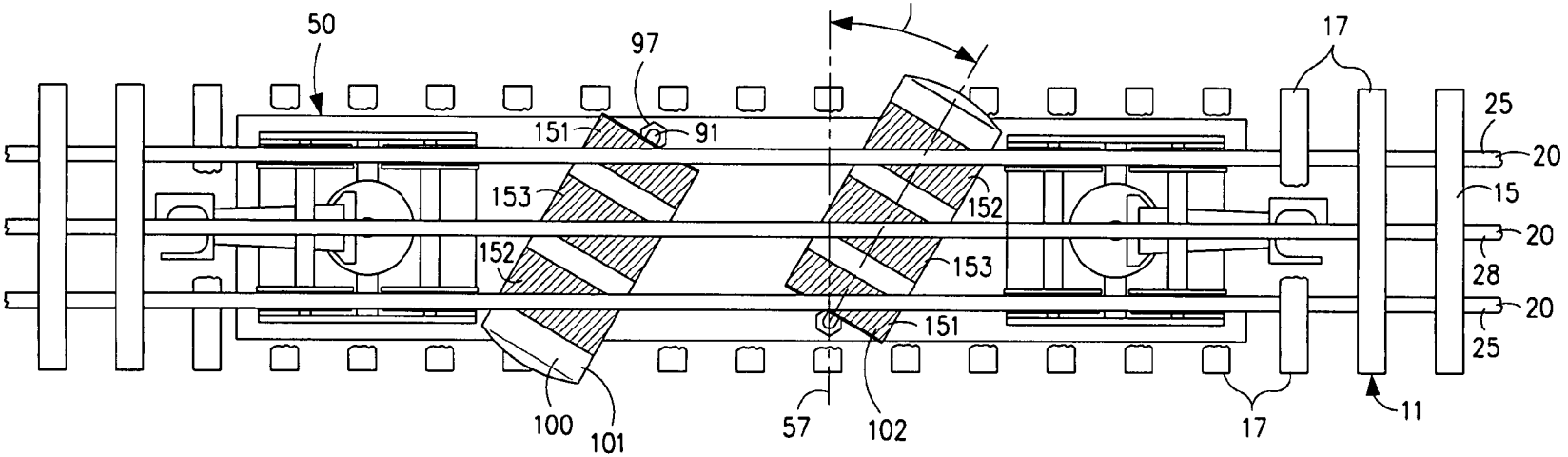
FIG. 2B is a bottom view of the track scrubbing car on 3-rail straight track with each roller at a 30° scrub angle so that movement of the car forms three circumferential working areas on each roller.
Figure 3A:
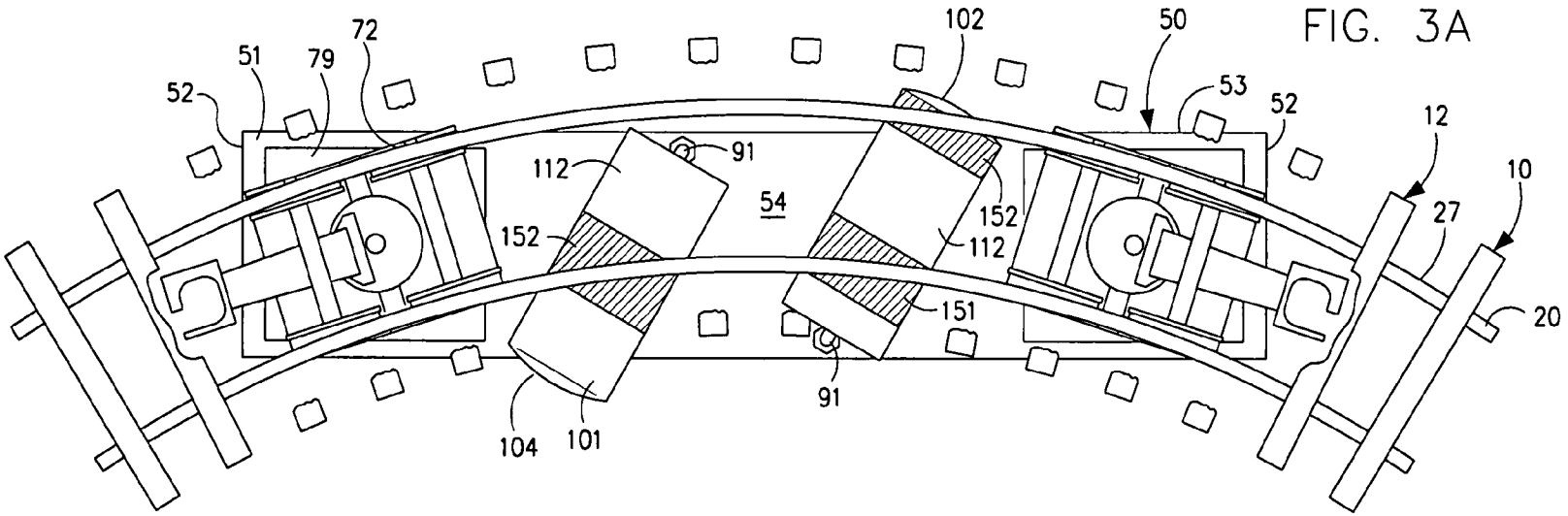
FIG. 3A is a bottom view of the track scrubbing car on 2-rail curved track with each roller at a 30° scrub angle, and showing the free end of one roller maintaining scrubbing engagement with the outermost rail.
Figure 3B:
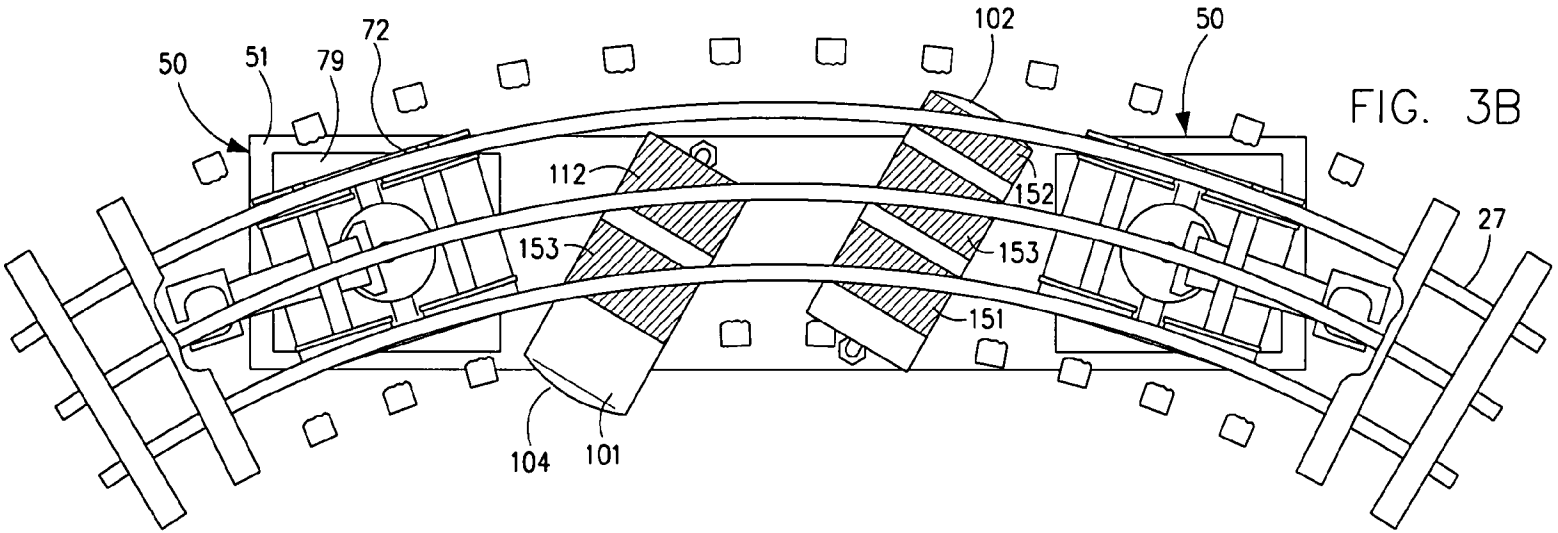
FIG. 3B is a bottom view of the track scrubbing car on 3-rail, O-27 inch curved track with each roller at a 30° scrub angle, and showing the free end of one roller maintaining scrubbing engagement with the outermost rail.

The present invention pertains to a track scrubbing car shown generally by reference number 50 in drawing FIG. 1. The car 50 has an elongated main body or chassis 51 with a solid construction that is preferably made of aluminum and stainless-steel. The elongated chassis 51 has a generally rectangular shape with opposed ends 52, parallel sides 53, and generally flat upper and lower surfaces 54 and 55. The car 50 is reversible so that it can run along the track in either direction without effecting its cleaning performance. Thus, any reference to a front or rear end 52 of the car 50 is for traveling or in-motion reference only. Pivot holes are drilled through the chassis 51 along its longitudinal centerline near its front and rear ends 52 for securing the wheel assemblies 71. The car 50 has a pivot point to pivot point length of about eight inches for an O-gauge layout. The car 50 has a pivot point to pivot point length of about nine and one-quarter inches for a Standard and G-scale layout. As discussed below, the chassis 51 has a normal axis 57 that is generally perpendicular to its longitudinal centerline and the track rails 20 when the car 50 is on straight track 11. The O-gauge chassis 51 has a width of about 2½ inches and a length of about 10 inches, and its sides 53 are within the side margins or perimeter 17 of the track 10 when the car 50 is traveling along straight track 11 as shown in FIGS. 2A and 2B. The sides 53 of the middle section of the car 50 can extend beyond the inner side margin of the track when the car is traveling along a high radius or tightly curved track 12 as shown in FIGS. 3A and 3B.

The chassis 51 supports a weight or mass 61 on its upper surface or bed 54. The weighted mass 61 is preferably a decorative polished, stainless steel pipe supported by wooden cribbing 62. The chassis 51 and load or mass 61 have a combined weight of about two and a half pounds for O-Gauge track, and about four pounds for Standard Gauge and G scale track. A number of cribbing holes (not shown) are drilled through the chassis 51. These cribbing holes are uniformly spaced along and proximal to both sides 53 of the chassis 51. The holes extend through the ends of the cribbing 62 to receive the nuts and bolt fasteners to firmly secure the cribbing 62 to the bed 54 of the chassis 51. The decorative pipe 61 is held in place against the cribbing 62 by elastic straps 65 that also give the car 50 a realistic visual appearance. Although the weighted mass 61 is shown and described as a decorative pipe, it should be understood that it could take on a variety of forms without departing from the broad aspects of the invention.

Figure 4:
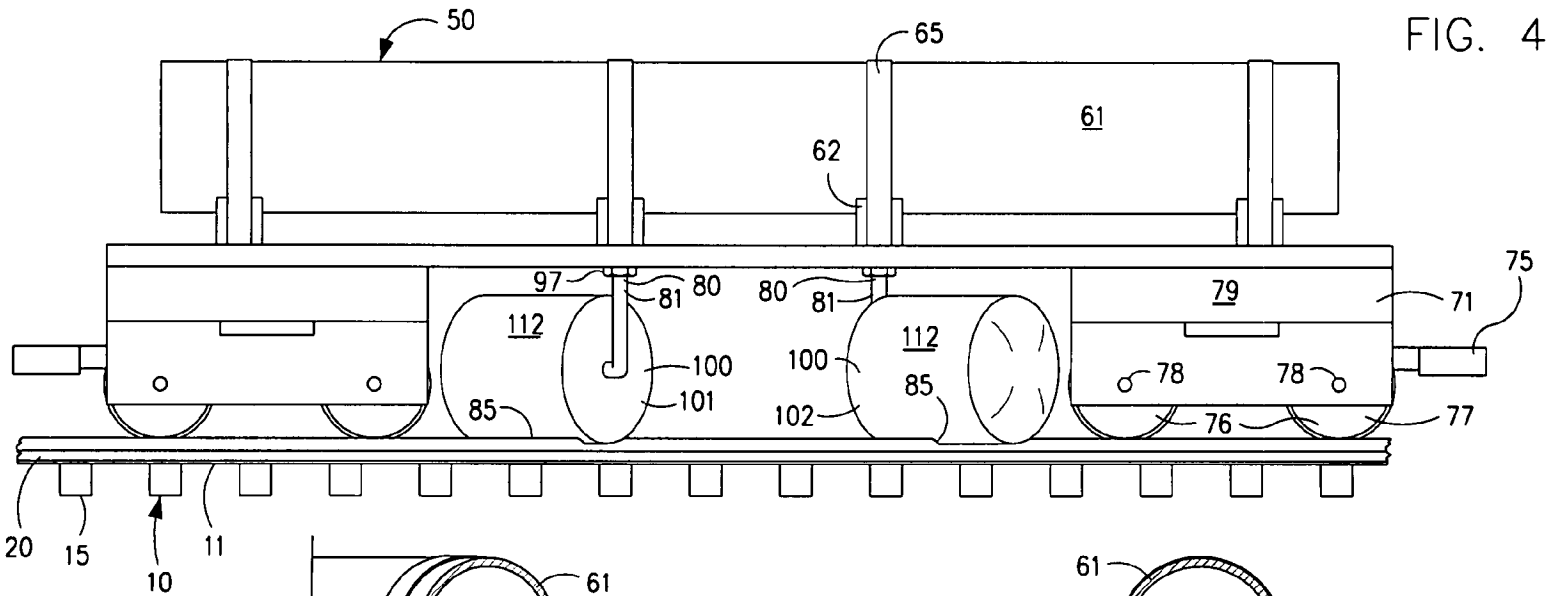
FIG. 4 is a side plan view showing the chassis of the car, its wheel assemblies, and rollers compressingly engaging the track rails.

Wheel assemblies 71 are pivotally secured to the chassis 51. One wheel assembly 71 is secured via the pivot hole at a first or forward end 52 of the chassis 51, and another wheel assembly 71 is secured via the pivot hole at its other or rearward end. Each wheel assembly 71 includes a conventional die-cast sprung truck 72 that is rotatably mounted to the chassis 51 via a pivot pin 74 that extends through its respective chassis pivot hole. Each truck 72 includes a conventional coupler 75 for joining the car 50 to a locomotive or other car of a train. Each trunk 72 also includes two sets 76 of wheels 77. Each set 76 of wheels 77 is joined by an axle 78 that is rotatably held by the truck 72. Each set 76 includes a first wheel 77 that engages one outside rail 25 of the track 10, and a second wheel 77 that engages the other outside rail. As best shown in FIG. 4, each truck 72 is modified to include a riser 79 that spaces the chassis 51 further above the rails 20. The wheel assemblies 71 keep the chassis surfaces 54 and 55 generally parallel to and a constant uniform distance above the tops 21 of the rails 20.

The track scrubbing car 50 includes a track scrubbing mechanism 80 that is preferably formed by two roller assemblies 81 and 82. The first roller assembly 81 is located proximal a first or front end 52 of the car, and the second roller assembly 81 is located proximal a second or rear end 52 of the car. Each roller assembly 81 and 82 extends down from and is positioned under the chassis 51. Each assembly 81 and 82 is a combination of rigid and flexible components. These components cooperate to position an active working surface 85 into compressed engagement with the tops 21 and sides 22 of the track rails 20. Each assembly 81 and 82 also allows the rails to push against and move or rotate that active working surface 85, which generates a larger total circumferential working surface area. The working surfaces 85 are a resilient to ensure continued compressing engagement with the rails.

Figure 6:
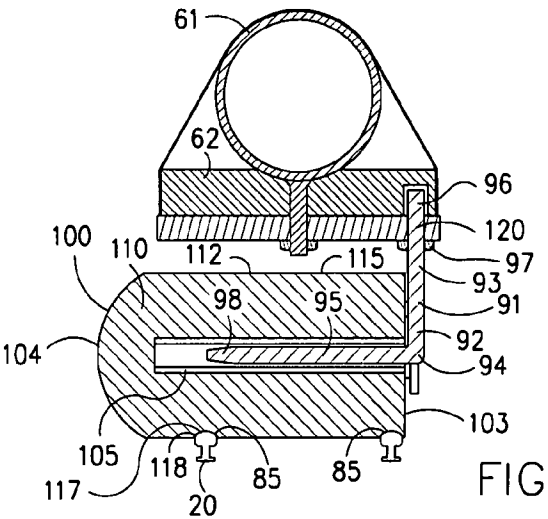
FIG. 6 is a sectional end view showing the roller compressed around the rails to engage the top and sides of the rails.
Figure 5:
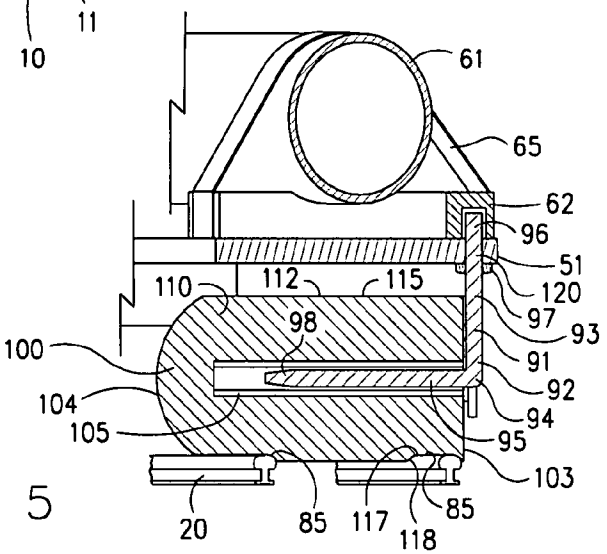
FIG. 5 is a sectional side-end view showing the height adjustment mechanism and the roller compressingly engaging the rails.

As best shown in FIGS. 5 and 6, in the preferred embodiment, each roller assembly 81 and 82 includes a roller mount 91 formed by a bent, rigid metal shaft 92. Each shaft 92 is preferably made of stainless steel, and has a vertical portion 93, a ninety degree bend 94, and a horizontal portion 95. The vertical portion 93 has an anchored end 96 held by a lock nut 97. The horizontal portion 95 has a free end 98. The vertical portion 93 of each shaft 92 is anchored to an opposite side 53 of the chassis 51. The anchored end 96 is thread received by and through an aligned chassis and cribbing hole. The shaft 92 is rotationally secured to the chassis 51 by lock nut 97. The vertical portion 93 of the shaft 92 has a length of about 1¼ inches to position its bend 94 and horizontal portion 95 a desired distance from the tops 21 of the track rails 20.

The horizontal portion 95 of each roller mount 91 extends from the bend 94, which is located below and proximal one side 53 of the chassis 51, toward the opposite side of the chassis. The horizontal portion or axle 95 of the shaft 92 has a length of about 1¾ inches, and does not extend completely across the chassis 51, even when in-line with the normal axis 57 of the car 50. The outer surface of the horizontal shaft or axle 95 is smooth to allow free rotation of the rollers. The rollers include a locking mechanism that prevents them from sliding along the length of the axle 95 without inhibiting the free rotation of the roller about the axle. The free end 98 is tapered to help receive a cleaning roller 100.

The cleaning mechanism 80 includes at least one cleaning roller 100, and preferably at least two rollers 101 and 102, each being held by its own cleaning assembly 81 and 82. Each cleaning roller 100 has an elongated cylindrical shape with a uniform uncompressed diameter of about 1⅜ inches, and a length of about 2½ inches between its ends 103 and 104. One end 103 is flat and the other end 104 is rounded or bowl shaped. Each roller 100 is rotatably mounted to the horizontal axle 95 of the shaft 92 of its roller assembly 81 or 82. The flat end 103 is located near bend 94, and the rounded end 104 extends about ¾ inch beyond the free end 98 of the shaft 92. Each roller 100 has a rigid, central sleeve 105 that supports a tubular, resiliently compressible cleaning roll 110. Although the rounded end 104 is shown as the free end of the roller, one of skill in the art will understand that either end can be flat or rounded, particularly given the may shapes of conventional paint rollers.

The sleeve 105 is free to rotate about the horizontal shaft 95 of its roller mount 91. The sleeve 105 is hard plastic and has an open central interior that receives the horizontal shaft 95. This shaft or mounting axle 95 defines the rotational axis of its roller 100. The sleeve 104 has a smooth inside surface that forms a substantially frictionless bearing surface that engages the mounting axle 95 of its roller assembly 81 or 82. Each roller 101 and 102 is free to rotate about its mounting axle 95. The sleeve 105 has an outer diameter of about ½ inch, and has a length of about 2 inches. The shorter axle 95 and longer sleeve 105 maintain the position and linear shape of the rotational axis of the roller 100 along the full length of the roller, even beyond the free end 98 of axle 95. The rollers 101 and 102 easily snap fit onto and off of their respective shaft or axle 95. The barb or locking mechanism (not shown) located within the sleeve 105 prevents the rollers 100 from sliding down the length of their axle 95 during use.

The cleaning material 110 is in the shape of a tubular roll. The cleaning roll 110 has an outer working surface 112 and an inner surface secured around and firmly held by the sleeve 105 so that they rotate in concentric unison about mounting axle 95. The tubular cleaning roll 110 has a uniform uncompressed radial thickness of about 7⁄16 inches, and is made of highly absorbent foam. The foam material 110 is also compressible with a springiness that resists compression and biases the material into a natural uncompressed shape and thickness 115. When a portion 117 of its working surface 112 is compressed into a compressed shape 118 against one of the track rails 20, the compression of the cleaning material 110 generates a rubbing or pushing force against that rail. The foam material 110 is resilient so that the working surface 112 in the point or area of the compressed portion 117 quickly returns to its natural uncompressed shape 115 when that portion disengages or rotates away from the rail 20. In the preferred embodiment, the rollers 100 are conventional paint rollers with a foam material 110 having absorption, compressibility and springiness characteristics of a household paint-trim roller such as that sold by Foam Pro. For O-gauge and Standard or G-scale track, Foam Pro Model No. 163 or 165 rollers are preferable, respectively.

A height adjustment mechanism 120 adjusts the height of its roller axle 95 relative to the track rails 20, and the amount of compression of in the active working surfaces 85, 117 of the outer surfaces 112 of the rollers 100 against the rails. Each roller assembly 81 and 82 preferably has its own height adjustment mechanism 120 for adjusting its roller 101 or 102 as shown in FIGS. 5 and 6. For a 1⅜ inch diameter (11⁄16 inch radius) roller 100, the roller axle 95 is preferably in the range of about ⅞ and ¾ inch from the bottom surface 54 of the car 50. When the car 50 is place on the track 10, each roller axle 95 is preferably in the range of about 7⁄16 and 10⁄16 inch from the top 21 of the rails 20, and preferably about 9⁄16 inch from the top of the rails. The roller axle 95 height is less than the radius of the rollers 100 so that the active working surface 85 of the rollers at their pressure points 117 are compressed a distance of about ⅛ inch into the track rails 20 to forcibly engage and wrap around the rails.

For 1⅜ inch diameter roller 100, a roller axle 95 height of 9⁄16 inch will compress the active working surface 85 of the roller against each rail 20 a distance of about ⅛ inch. The roller axle 95 height is adjusted by removing the foam roller 100, and loosening the lock nut 97 with a wrench. Then, the vertical portion 93 of the mounting shaft 92 is rotated either up or down, in one revolution increments, to adjust the roller axle height and the amount of compressive or downward force exerted by the rollers 100 on the rails 20. The active working surface 85 of each roller 100 should engage the top 21 and sides 22 of the rails 20. The car 50 and its decorative mass 61 weigh about 2 lbs. 7 oz., which is sufficient to overcome the stiffness of the roller material 110 so that the wheels 77 of the car remain engaged with the track rails 20. The total weight of the car 50 should not be so great as to cause derailments or prevent the engine from pulling or pushing the car along the track 10. The car 50 can be either pulled or pushed around a layout, although pulling may be preferable.

Each roller axle 95 is set to a desired scrub angle 140. The scrub angle 140 is adjustable for each roller 100 by simply selectively rotating its axle 95 about its threaded pivot hole in the chassis 51 to point the axle and roller 100 to the desired scrub angle. The scrub angel 140 is measured relative to the normal axis 57 of the car 50. In combination with the height adjustment mechanism 120 and the characteristics of the cleaning material 110 such as its softness and coefficient of friction, the scrub angle 140 controls the amount of scrubbing action produced by the rollers 100. The greater the scrub angle 140, the more scrubbing action across the rails 20. The scrub angle 140 is preferably in the range of about 10° to 50°, and is most preferably about 30°. The roller assemblies 81 and 82 are located on the chassis 51 of the car 50 so that the free ends 104 of the rollers 101 and 102 are as close as possible to their adjacent wheels 77 without touching the wheels when traveling along a curved section 12 of track 10. One roller 101 is preferably rotated into a forward 30° scrub angle 140, and the other roller 102 is rotated to a rearward 30° scrub angle. This allows the one roller 101 to better scrub one side 21 of the rails 20, the other roller 102 to better scrub the other side of the same rails, and both rollers to scrub the tops 21 of the rails. This scrub angle arrangement of the rollers 101 and 102 leaves the tops 21 and both sides 22 of the rails 20 wiped clean after one pass of the car 50.

The roller scrub angle 140 affects both the rate of rotation of that roller 100 and the amount of scrubbing action of its active working surface 85 against the rails 20. The smaller the scrub angle 140, the faster the roller 100 rotates relative to the movement of the train, and the less the scrubbing action. The greater the scrub angle 140, the slower the rollers 100 rotate relative to the movement of the train, and the more the scrubbing action. Where the roller 100 to approach 90° scrub angle 140, the roller 100 would not rotate and all the motion of the train would result in 100% along-the-rail dragging or scrubbing action between the working surface 85 of the roller and the rails 20. Yet, the lack of roller rotation means that only a small arcuate section 117 of its working surface 112 is used, and that small section quickly wears out unless the roller 110 is manually rotated. When one roller is at a forward scrub angle 140 and the other roller is at a rearward scrub angle as in FIGS. 3A and 3B, one roller will rotate faster on curved track 12 (roller more parallel to curved rails), and the other roller will rotate slower (roller more perpendicular to rails). If necessary, the scrub angle 140 can be increased and a longer roller 100 used to ensure the outermost rail 27 is scrubbed clean.

Figure 8:
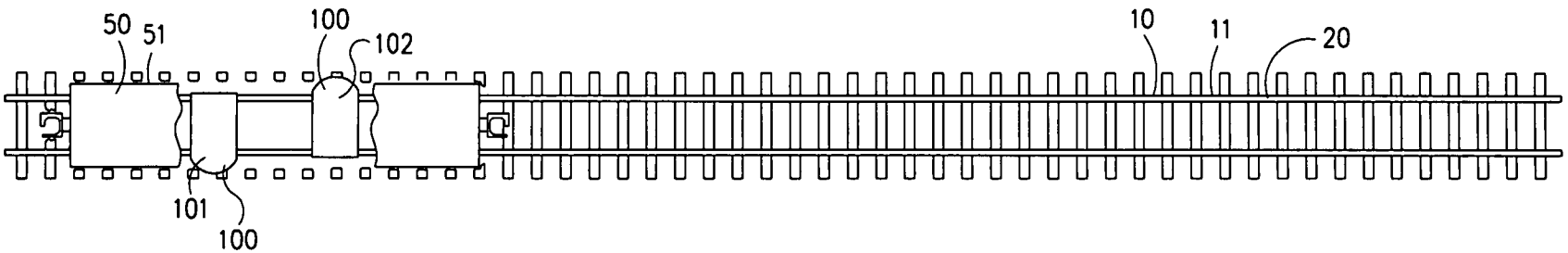
FIG. 8 is a top view of the track scrubbing car with its rollers at a 30° scrub angle during a test in which the car moved along a six foot section of straight track.

When the car 50 is moving along the track 10 as in FIG. 8 with the active working surfaces 85 of the rollers 100 compressed against the rails 20 and the scrub angle 140 of each roller 101 and 102 set to 0° so that the rollers and their axles 95 are parallel to the normal axis 57 of the car, then the rollers 100 rotate at a rate where there is little or no dragging or scrubbing action between the active working surface 85 and the rails. The frictionless sleeves 105 allow the working surfaces 112 of the rollers 100 to roll along the rails 20 much like the wheels 77 of the car. When 1⅜ inch diameter rollers 100 have their axle 95 spaced about 9/16 inch from the top 21 of the rails 20 and are each is set to a 0° scrub angle 140, the rollers turn about 20 revolutions when traveling along a six foot (72 inches) length of track 10. Given the 9/16 inch effective rolling radius (about 3.5 inch effective rolling circumference), the total rolling distance is about 72 inches. The rollers roll on and do not scrub the track 10.

As the scrub angle 140 of the roller 100 increases toward 90°, the roller rotates at an increasingly slower or reduced rate (fewer revolutions per minute) so that the active working surface 85 of the roller 100 may partially drag along and across the rails 20. The scrub angle 140 may cause the active working surfaces 85 to produce an angled scrubbing action relative to the rails 20, which produces an across-the-rail scrubbing action and may also produce a simultaneous along-the-rail scrubbing action. The across-the-rail or lateral scrubbing action scrubs up the side 22 of each engaged rail 20 and across the tops 21 of those rails. The along-the-rail or longitudinal scrubbing action is in the direction opposite the motion of the car 50. For a car 50 with two rollers 101 and 102 set to a 30° scrub angle 140, a locomotive engine requires about 6 to 9 ounces of force to pull the car along the track 10 at a scale speed of about 20 miles per hour. Yet, the locomotive engine requires relatively little force to pull the car 50 when those same rollers 101 and 102 are set to a 0° scrub angle 140. A typical locomotive engine can pull with about one pound (16 ounces) of force, and a modern twin motored engine can pull with about two to two and a half pounds of force.

Figure 7:
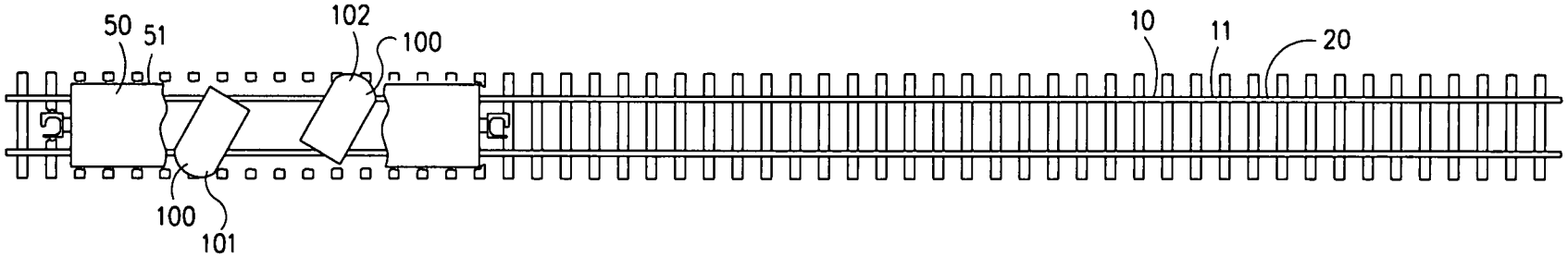
FIG. 7 is a top view of the track scrubbing car with its rollers at a 0° scrub angle so that they are perpendicular to the track rails during a test in which the car moved along a six foot section of straight track.

When one roller 101 is set to a forward 30° scrub angle 140 and the other roller 102 is set to a rearward 30° scrub angle 140 as in FIG. 7, the rollers only turn 15 revolutions when traveling along the same six foot length of track 10 described above. This may produce some dragging or along-the-rail scrubbing action. Each roller 100 is simultaneously rotating its working surface 112 and providing scrubbing action to clean the rails. The along-the-rail force or scrubbing action cause the roller 100 to rotate about its roller axle 95 so that the entire 360° circumference of the working surface 112 of the roller 110 contributes to the active working engagement 85 with the rails 20. Portions 117 of its working surfaces 112 rotate into and out of active engagement 85 with the rails 20 so that the complete circumference of the working surface 112 is automatically used to clean the rails as the car 50 travels along the track 10.

The roller scrub angle 140 also affects width of the active working surface 85 against each rail 20, and the width of the working surfaces 151, 152 and 153 as shown in FIGS. 2A and 2B. When the car 50 travels along straight track 11 for a 3-rail O-gauge layout, the roller axle 95 is spaced 9/16 inch from the rail 20 and a 1⅜ inch diameter roller 100 is set to about a 30° scrub angle 140, the individual circumferential working surfaces 151, 152 and 153 are as in FIG. 2B. Although the tops of O-gauge rails 20 are only about 3/32 inch wide, the width of each working surface 151, 152 and 153 is about ½ inch wide when the car is traveling along straight track 11. Were the scrub angle 0° or almost 0°, the width of each active working surface 85 and each circumferential working surface 151, 152 or 153 would each be more equal to the width of the one rail 20. Increasing the scrub angle 140 increases the width of the active working surface 85 and the width of the circumferential working surfaces 151, 152 and 153. The greater the diameter of the roller 100, the greater the increase in width of the circumferential working surfaces 151, 152 and 153, because the active working surface 85 becomes less arcuate and more resembles a flat surface. In addition, the greater the roller compression, the greater the increase in width of the circumferential working surfaces 151, 152 and 153. This is because more of the active working surface 85 wraps around and engages the sides 22 of the rail 20.

FIGS. 3A and 3B show the cleaning car 50 on 2-rail and 3-rail O-gauge curved track 12, respectively. The cleaning rollers 101 and 102 are in compressed engagement with the tops 21 and sides 22 of each rail 20. When the car includes two rollers 100 with opposite scrub angles as shown, one roller 101 remains engaging with both outer rails 25 including the outermost rail 27 even while traveling along curved track 12. While the secured end 103 of the rollers 101 and 102 remain within the cross ties 15 and outer margins 17 of the track 10 when traveling along straight track 11 and curved track as shown in FIGS. 2A, 2B, 3A and 3B. The free ends 104 of the rollers 100 overhang or extend beyond the margins 17 of the track by 5/16 of an inch when the car 50 is on straight track 11 and the rollers are set at a 30° scrub angle. One of the rollers 102 further exceeds the inner margin 17 when traveling along a high radius curve track 12 as shown in FIGS. 3A and 3B.

Prior to placing the car 50 on the track 10 for operation, the rollers 100 should not contact the wheels 77 of the trucks 72, but should be as close to the trucks as possible. This should in fact provide a scrub angle 140 of about 30°. A small amount of all purpose cleaner such as GOO GONE™ cleaning and degreasing preparation or other citrus type cleaner should be applied across both rollers 100 in four to five spots so the cleaning material 110 is thoroughly moistened. The car 50 is then set on the track 10 and hook-up behind an engine. The car 50 is then pulled at slower to mid level speeds. Clean one loop or section of a layout at a time and pull car around three to four times. There should be a noticeable build up on the rollers 100 depending on the amount of dirt on the track 10. Remove dirty rollers 101 and 102 and install the second set of dry rollers. Pull the dry rollers 100 around the track to wipe up any cleaning residue the rails 20. This step may be repeated depending on the amount of build-up on the rails 20. Cleaning the track 10 should noticeably improve your train performance. The rollers 100 can be washed with dish soap and warm water. Rinse the cleaning material or rolls 110 clean, ring them out and to let dry. Repeat on layout until the rollers 100 pull clean across the track 10.

While the invention has been described with reference to a preferred embodiment, it will be understood by those skilled in the art that various changes may be made and equivalents may be substituted without departing from the broader aspects of the invention.

I claim:

1. A track scrubbing car for an electric model railroad having straight and curved track joined together to form a layout for an electric locomotive to propel a train along the layout, the track having at least two spaced apart outer rails, each rail having a narrow width, the locomotive having at least one set of two spaced apart wheels, the outer rails supportingly engaging and guiding the wheels as the locomotive moves the train along the layout, the outer rails forming a portion of an electric circuit that supplies electric power to the locomotive via conductive engagement with its wheels, said track scrubbing car comprising:

a chassis having front and rear ends and longitudinal and normal axes, said chassis including a front wheel assembly secured proximal said front end and a rear wheel assembly secured proximal said rear end, each wheel assembly being pivotally secured to said chassis and including at least one set of spaced apart car wheels, said track scrubbing car having a desired car weight, and said car wheels being adapted for weight supporting engagement with the outer rails and movement along the track rails via the locomotive;

a first cleaning assembly having a first roller mount and a first roller, said first roller mount being secured to said chassis and forming a substantially horizontal first roller axle to rotatably support said first roller under said chassis, said first roller axle being at a first scrub angle relative to said normal axis of said chassis, said first roller having a first roller diameter and a generally cylindrical shape with an outer surface, said first roller including a tubular roll made of a compressible and resilient material;

a second cleaning assembly having a second mount and a second roller, said second mount being secured to said chassis and forming a substantially horizontal second roller axle to rotatably support said second roller under said chassis, said second roller axle being at a second scrub angle relative to said normal axis of said chassis, said second roller including a tubular roll made of a compressible and resilient material;

each said mount being adapted to firmly position its said roller axle at a height of less than half its said roller diameter above the track rails, said first roller compressively engaging at least the first rail and said second roller compressively engaging at least the second rail while maintaining said weight supporting engagement between said car wheels and the track rails, said compressed engagement forming an active working surface on each roller, said active working surface deforming around the top and engaging the side of its respective at least one rail; and, wherein the movement of said track scrubbing car along the track rails provides across-the-rail scrubbing action between said rollers and the rails and simultaneous rotation of said rollers about their said axle, each said roller having at least one circumferential working area resulting from said rotation of said roller along its at least one rail, and each said circumferential working area have a working width greater than the narrow width of its respective rail when moving along the straight track.

2. The track scrubbing car of claim 1, and wherein each said scrub angle is between about 10° and 50°.

3. The track scrubbing car of claim 2, and wherein each said scrub angle is about 30°.

4. The track scrubbing car of claim 2, and wherein said tubular roll is made of an absorbent foam material.

5. The track scrubbing car of claim 4, and wherein said scrubbing action includes both across-the-rail scrubbing action and along-the-rail scrubbing action.

6. The track scrubbing car of claim 4, and wherein each of said rollers freely rotates on its said roller axle.

7. The track scrubbing car of claim 6, and wherein said chassis has a middle and first and second sides, and said first roller mount is secured between said middle and said front end of said chassis and extends downwardly from said first side with its said roller axle extending at its said scrub angle toward said second side, and said second roller mount is secured between said middle and said rear end of said chassis and extends downwardly from said second side with its said roller axle extending at its said scrub angle toward said first side, and wherein each said roller has a centerline linearly aligned with its said roller axle and spans from said first side to said second side of said chassis to compressingly engage both of the outer rails when said track scrubbing car is traveling along the straight track.

8. The track scrubbing car of claim 7, and wherein said scrub angle of said first roller is angled in a forward direction relative to said normal axis of said chassis toward said front end of said chassis, and said second scrub angle of said second roller is angled in a rearward direction relative to said normal axis of said chassis toward said rear end of said chassis.

9. The track scrubbing car of claim 8, and wherein the curved track is sharply curved track and one of the outer rails of the curved track is an outermost rail, and wherein each roller axle has a free end, and each roller has a predetermined length and an outer free end extending beyond its respective side of said chassis, and one of said rollers remains compressingly engaged with the outermost rail when said track scrubbing car is traveling along the sharply curved track.

10. The track scrubbing car of claim 9, and wherein the track is O-gage track with a center rail, and the electric locomotive has at least one electric contact on its underside to conductively engage the center rail, and wherein each of said rollers is adapted to simultaneously compressively engage both outer rails and the center rail to form three circumferential working area on each said roller when the track scrubbing car is traveling along the straight track, and each of said rollers is adapted to simultaneously compressively engage at least one outer rail and the center rail to form at least two circumferential working area on each said roller when the track scrubbing car is traveling along the curved track.

11. The track scrubbing car of claim 10, and wherein each of said rollers includes a rigid central sleeve that snuggly receives its said roller axle, each of said rollers has a length of about 2½ inches, said diameter of each of said rollers is about 1⅜ inches, and said tubular roll of each said rollers has a thickness of about ½ inch.

12. The track scrubbing car of claim 1, and wherein each said roller mount includes a roller axle height adjustment mechanism to allow selective adjustment of said roller axle height and said compressing engagement between said roller and its respective track rails.

13. The track scrubbing car of claim 12, and wherein said chassis includes a weighted mass to increase said car weight.

* * * * *